United States Patent [19]

Meckel et al.

[11] 4,360,976

[45] Nov. 30, 1982

[54] DRY COOLING OF COKE

[75] Inventors: Joachim Meckel, Heiligenhaus; Horst Joseph; Dietrich Wagener, both of Essen, all of Fed. Rep. of Germany

[73] Assignee: Didier Engineering GmbH, Fed. Rep. of Germany

[21] Appl. No.: 224,017

[22] Filed: Jan. 12, 1981

[30] Foreign Application Priority Data

Jan. 12, 1980 [DE] Fed. Rep. of Germany ..... 3000992

[51] Int. Cl.[3] ..... F26B 5/00; F26B 17/14

[52] U.S. Cl. ..... 34/20; 34/54; 34/233; 34/168; 432/79

[58] Field of Search ..... 34/20, 54, 225, 233, 34/168; 432/36, 77, 79, 80; 236/49

[56] References Cited

U.S. PATENT DOCUMENTS 2,676,095 4/1954 De Vaney et al. ..... 34/54

4,037,330 7/1977 Kemmetmuller ..... 432/77

*Primary Examiner*—Larry I. Schwartz

*Attorney, Agent, or Firm*—Wood, Herron & Evans

[57] ABSTRACT

A method and apparatus for the dry cooling of coke is disclosed wherein a cooling gas is routed through a coke charge by means of a distributor or manifold disposed in the bottom of a vertical cooling chamber. The gas passing upwardly through the coke charge is heated by the hot coke. A temperature sensor is provided in the discharge line for the heated gas from the coke cooling chamber, and the distribution and flow rate of the cooling gas introduced at the bottom of the chamber is controlled thereby to maintain a predetermined temperature of the discharged gas. A further embodiment includes multiple gas discharge lines located at different levels of the coke charge. Since the temperature of the gas discharged varies with the level from which the gas is withdrawn, controlled combination of the various discharge flows provides an additional means for producing and maintaining the predetermined temperature of the combined gas discharge.

5 Claims, 2 Drawing Figures

DRY COOLING OF COKE

BACKGROUND OF THE INVENTION

This invention relates to a method and apparatus for the dry cooling of coke and, more particularly, to an improved method and apparatus where the temperature of the discharged cooling gas from the coke cooling apparatus is kept relatively constant over the entire operating time, through the regulation of the introduced cooling gas and/or the regulation of a combination of multiple flows of discharged cooling gas from the apparatus.

In the production of coke from coal, the coal is heated to elevated temperatures in the absence of air. Heating is done in a battery of coke ovens, and on completion of the coking operation, the incandescent coke is removed in batches from the coke ovens. Since the hot coke will readily burn if exposed to the oxygen in the ambient atmosphere, it must be quickly cooled.

One method of cooling the hot coke is through quenching with a water spray. Another method, a dry method, involves the cooling of the coke by circulating a gas through the coke charge from the lower to the upper end of a cooling chamber. The heated gas may then be withdrawn from the cooling chamber for subsequent use.

In dry coke cooling systems which do not have a prechamber for the hot coke, the coke charges are introduced directly into the cooling chamber. Both the gas serving as the cooling medium and the coke therefor leave the cooling chamber at temperatures which may fluctuate from charge to charge. This interferes with various subsequent treatment processes of both the hot cooling gas and cooled coke, often requiring expensive techniques to attain relatively uniform temperature from batch to batch. Such a problem exists in utilizing the latent heat held by the discharged gas in a subsequent process, such as for coal preheating, where it is highly desirable that the preheating gas be of relatively uniform temperature.

BRIEF DESCRIPTION OF THE INVENTION

It is among the principle objects of this invention to provide a method and apparatus for the dry cooling of coke, wherein the gas used to cool the coke is discharged from the coke cooling chamber at a temperature which remains relatively constant over the entire operating time of the apparatus, irrespective of the temperature of the charged coke or the interval of charging.

To this end, a method and apparatus for the dry cooling of coke are disclosed which provides for the constant monitoring of the coke cooling gas as it leaves the cooling chamber. The hot gas leaving the chamber is continuously checked to determine whether it leaves the chamber at a desired predetermined temperature. In the event that significant temperature fluctuations are detected, a primary adjustment is made to the distribution of the cooling gas flowing through the coke charge with repeated adjustments being made thereafter until the predetermined gas discharge temperature is reached. By thus initially regulating the distribution of the cooling gas, a relatively constant predetermined gas discharge temperature is maintained and more uniform cooling of the coke is effected as well since the regulation of the gas distribution causes a more intensive flow of cooling gas through hotter or burning coke pockets.

In addition to the regulation of the gas distribution in the chamber, the flow rate of the gas passing through the coke charge can be adjusted through the regulation of the rate of introduction of the gas into the cooling chamber if, for example, the predetermined temperature of the gas discharged from the cooling chamber cannot be achieved through redistribution of the cooling gas alone.

In the application of the process, it may be desired to discharge the cooling gas flowing through the coke charge at various horizontal levels of the coke cooling chamber, and then mix the gas flows which are at different temperatures with one another. The discharge temperature of the combined gas flow is then measured and regulated by controlling the volume of the individual partial flows until the predetermined temperature is obtained in the combined gas stream.

In one preferred embodiment of this invention, the coke cooling gas is removed from the coke dry cooling apparatus at about 800° C. The set value of the temperature control device is adjusted to that temperature. The coke charges are introduced directly into the cooling chamber at a temperature of about 1000° C.

The heat transfer effected after introduction of a new coke charge is initially altered through the use of gas flow control valves in the various feed lines of the cooling gas to the cooling chamber which serve to redistribute the flow of the cooling gas being introduced into the cooling chamber to the extent necessary to bring the discharge temperature of the cooling gas (now heated by passing over the hot coke) to the predetermined 800° C. range. As the temperature of the coke drops, the temperature of the gas being discharged also tends to fall, and the temperature measurement and control device thus causes distribution of the cooling gas being introduced into the cooling chamber. The resulting heat transfer is consequently improved to maintain the predetermined temperature of 800° C. for the gas discharged from the chamber.

Control of the dry cooling system in this manner is effective over the entire operating time in that after the optimum heat transfer is obtained by regulating the distribution of the cooling gas in the chamber, the volume flow of gas to the chamber may be reduced to heat it to a higher temperature.

In another embodiment, the coke charge is introduced at a temperature of 1100° C., with a predetermined temperature for the gas discharge being set at 700° C. In this case, it is preferable to discharge the hot gas at two or more different horizontal levels of the coke charge, and then mix the discharge flows outside of the chamber to form a single gas discharge stream. A gas flow withdrawn at approximately the midpoint of the coke charge will have a considerably lower temperature than one withdrawn from an upper level.

As described in the first embodiment above, the desired discharge temperature of the gas is initially obtained by adjusting the distribution of the cooling gas being introduced into the chamber. As a complement to that operation, the temperature control unit regulates the relative volume of gases from the hotter and cooler gas discharge lines through gas flow control valves incorporated in the discharge lines to thereby maintain the desired temperature of 700° C. for the combined gas discharge. As the coke temperature drops, the control unit will first change the mixing ratio of the discharge flows to increase the relative amount of hotter gas and, thereafter, alter the distribution of the cooling gas being introduced into the cooling chamber and then the flow rate of the gas being introduced into the cooling chamber to maintain the predetermined gas discharge temperature.

This invention thus effectively produces through its regulating system a relatively uniform temperature of the cooling gas discharged from the cooling chamber as well as a more uniform temperature for the coke discharged from the cooling chamber. If the coke is insufficiently cooled when discharged, it can be after-quenched beneath the cooling chamber in accordance with generally known procedures. In general, the after-quench would be a wet process conducted in a quenching area below the cooling chamber, with the dry cooled coke being introduced solely by its own gravity.

These and other objects and advantages of the present invention will become apparent from the following detailed description taken with the accompanying drawings.

DETAILED DESCRIPTION OF THE INVENTION

Figure 1:
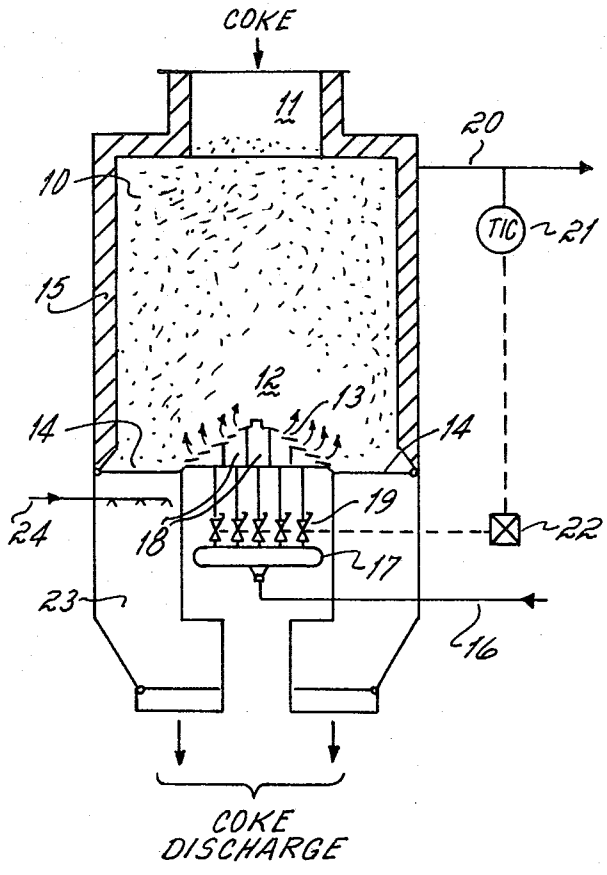
FIG. 1 is a side elevation schematic with parts in cross-section of one embodiment of the present invention.

Referring now to FIG. 1, the coke dry cooling apparatus includes a cooling chamber 10 into which coke to be cooled is introduced directly in batches through a hopper 11. The cooling chamber 10 is closed off at the bottom by a cooling gas distributor 12. The gas distributor 12 has inclined top sections which rise to its center, each section having a number of gas flow passages 13. Intermediate locks 14 extend from the bottom edge of the gas distributor 12 up to the outer wall 15 of the cooling chamber 10.

The gas serving as the coke cooling gas is introduced into the cooling chamber 10 through a gas feedline 16 connected to a manifold 17 located below the gas distributor 12. The gas distributor 12 includes individual gas distributor chambers 18 which extend up to the underside of the top sections of the gas distributor 12, for the controlled flow of gas through the gas passages 13. Gas flow control valves are located in each gas feedline from the manifold 17 and regulate the flow of gas to the individual distributing chambers 18.

Near the coke hopper 11 through which the coke is introduced into the chamber 10, which by the way does not include a prechamber, a discharge and transport line 20 extends out of the cooling chamber through which the hot gas heated by the hot coke is discharged from the dry coke cooling apparatus. A temperature sensor 21 is incorporated in the discharge line 20 in the relative vicinity of the cooling chamber 10 which measures the discharge temperature of the heated gas. This temperature sensor 21 is connected with a control 22 for regulating the valves 19. The temperature sensor 21 and the control 22 form a control unit for all of the flow control valves 19, which are controllable individually as well as jointly in groups depending on the temperature of the gas in the discharge line 20. This control unit 21, 22 is adjustable to a predetermined gas discharge temperature. Temperatures varying from the preset temperature produce signals which cause the control unit 21, 22 to regulate the flow control valves to adjust the cooling gas flow through the cooling chamber to thereby cause the temperature of the discharged gas to return to the preset temperature.

Located below the cooling chamber 10 in the area of the intermediate locks 14 are after-quenching spaces 23 in which the coke is cooled to an exit temperature of about 150° C. Arranged in these after-quenching spaces 23 are water spray devices 24 which cool the coke to the desired final temperature through a wet quenching process.

Figure 2:
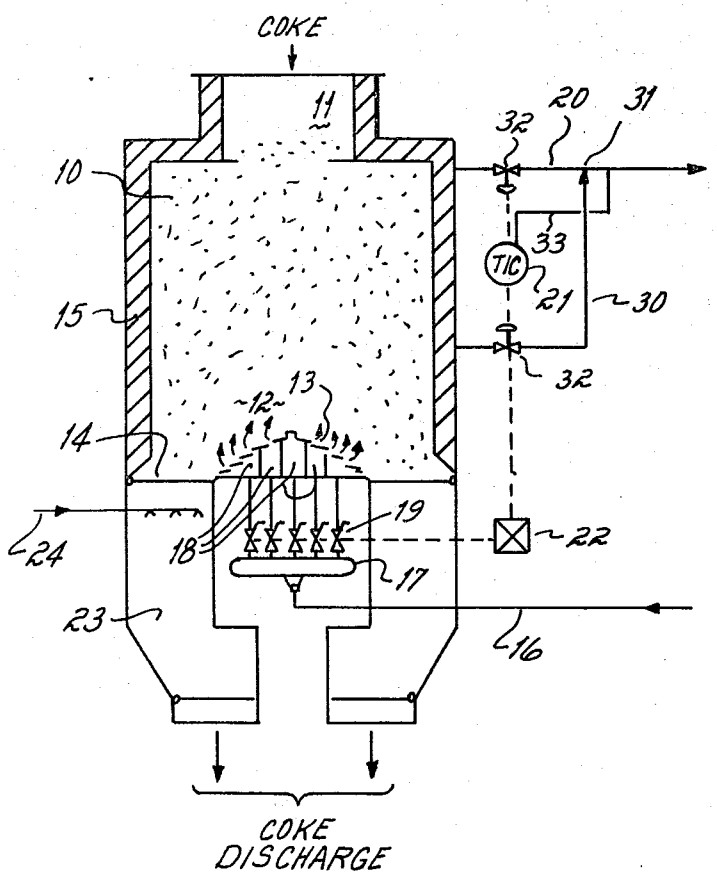
FIG. 2 is a side elevation schematic with parts in cross-section of another embodiment of the present invention.

Referring now to FIG. 2, essentially the same coke dry cooling apparatus is shown as is depicted in FIG. 1, differing only by the presence of a second gas discharge line 30. The two discharge lines 20, 30 withdraw the hot gas from the cooling chamber 10 at different levels and subsequently combine to form a single discharge gas transport line. One discharge line 20 is arranged in the upper area of the cooling chamber, as in FIG. 1, and extends as a transport line away from the coke dry cooling apparatus. The second discharge line 30 is located approximately at the midpoint of the coke charge, and joins at the first discharge line 20 to a junction 31, still in the vicinity of the cooling chamber 10. Incorporated between this pipe junction 31 and the cooling chamber 10 in each of the two discharge lines 20 and 30 are gas flow control valves 32. Both valves 32 are connected with a sequence control system of the control unit 21, 22 which regulates the mixing of the varying temperature gas discharge flows by controlling the individual rates of flow via the regulating armature 32. The temperature sensor 21 is connected to the combined discharge and transport line at a point downstream of the pipe junction 31 by line 33.

Placement of the temperature sensor at this point gives the control unit 21, 22 the ability sequentially to regulate the mixing ratio between the two discharge lines 20 and 30, to redistribute the flow of cooling gas being introduced at the bottom of the cooling chamber 10 when simply mixing the two discharge flows is insufficient to maintain the preset temperature for the discharged gas, and lastly to control the rate of flow of the gas introduced at the bottom of the cooling chamber when the optimum distribution has been obtained. This control sequence is directed at maintaining a relatively constant temperature for the gas being discharged from the cooling chamber independent of the coke charge introduced into the apparatus.

Although our invention has been described in terms of certain preferred embodiments, it should be appreciated that other forms may be adopted within the scope of this invention.

We claim:

1. In a process for the dry cooling of coke wherein hot coke is charged directly into the cooling chamber of a dry coke cooling apparatus in batches and an inert cooling gas is passed through the coke charge to thereby effect a heat exchange between the cooling gas and the hot coke whereby the hot coke is cooled by the gas passing over it and the gas is in turn heated by the hot coke and then discharged from the coke cooling apparatus, the improvement comprising the steps of providing a predetermined temperature for the gas discharged from the coke cooling apparatus, sensing the temperature of the gas discharged from the apparatus, providing a gas distributor having a plurality of gas flow chambers, and individually regulating the flow of gas into each of said gas flow chambers to control the distribution of gas introduced into the coke cooling apparatus in response to the sensed temperature of the discharged gas to maintain the temperature of the gas being discharged from the apparatus at said predetermined temperature.

2. The process of claim 1 comprising, in addition, the step of individually regulating the flow rate of the gas into each of said gas flow chambers to control the volume of gas introduced into the apparatus.

3. The process of claim 1 wherein the cooling gas discharged from the apparatus is discharged from at least two points located at different levels of the coke charge which are then mixed with each other exteriorly of the apparatus to form a combined gas flow, and wherein the temperature being sensed is the temperature of the combined gas flow, the process including the further step of regulating the individual gas flows discharged from the apparatus in response to the sensed temperature.

4. In an apparatus for the dry cooling of coke including a cooling chamber, a coke hopper through which coke can be introduced directly into the cooling chamber in batches, a cooling gas distributor located at the bottom of the cooling chamber for the introduction of cooling gas into the cooling chamber, said distributor including a plurality of gas flow openings and individual gas flow chambers communicating therewith and gas flow control valves for controlling the flow of cooling gas through said individual chambers independently one of another, discharge locks at the bottom of the cooling chamber for discharging the coke therefrom, and at least one discharge line for removing the cooling gas from the cooling chamber, said cooling gas being heated by the hot coke as it passes into contact therewith, the improvement comprising temperature sensing means for sensing the temperature of the gas in said discharge line, and control means adjustable to a predetermined temperature operationally connected to said temperature sensing means and to said gas flow control valves for regulating said valves to regulate the flow of cooling gas into said chamber in response to the temperature sensed by said temperature sensing means to thereby maintain the temperature of the gas in said discharge line at said predetermined temperature.

5. The apparatus of claim 4 further comprising at least a first discharge line connected to said cooling chamber in the upper section of the coke charge and a second discharge line connected to said cooling chamber between said first discharge line and the bottom of said cooling chamber, the two said lines combining to a single transport line exteriorly of said cooling chamber, and gas flow control valves in said first and said second discharge lines, said control means being operably connected to said gas flow control valves in said first and said second discharge lines and being operable to control the flow therethrough in response to the temperature sensed in said transport line.

* * * * *